United States Patent [19]

Cobb et al.

[11] Patent Number: 4,641,448

[45] Date of Patent: Feb. 10, 1987

[54] POST CAP APPARATUS

[75] Inventors: Ronald W. Cobb, Covington; Charles A. Lollis, Mableton, both of Ga.; Nancy S. Crane, Warrior, Ala.

[73] Assignee: Apco Graphics, Inc., Atlanta, Ga.

[21] Appl. No.: 693,006

[22] Filed: Jan. 18, 1985

[51] Int. Cl.[4] ..... G09F 15/00

[52] U.S. Cl. ..... 40/606; 40/10; 40/617

[58] Field of Search ..... 40/606, 607, 10, 605, 40/612, 617

[56] References Cited

U.S. PATENT DOCUMENTS

| | | | |
|---|---|---|---|
| 1,802,939 | 4/1931 | Butler | 40/607 |
| 4,068,398 | 1/1978 | Parisi | 40/607 |
| 4,209,927 | 7/1980 | Donatelle | 40/607 |
| 4,263,738 | 4/1981 | Donatelle . | |
| 4,276,706 | 7/1981 | Scott | 40/607 |
| 4,412,396 | 11/1983 | Silbernagel | 40/607 |

*Primary Examiner*—Gene Mancene
*Assistant Examiner*—Wenceslao J. Contreras
*Attorney, Agent, or Firm*—Jones & Askew

[57] ABSTRACT

A post sign having a message panel supported by one or more posts. Each post has an elongated channel connected to an outer side of the post by an elongated slot, and the message panel is mounted on the post or posts by an interconnecting support member which fits in the channel, leaving exposed an upper terminal portion of the channel and slot. The open upper end of the support member is covered by a spacer cap, and the open upper end of the post is covered by a post cap having a tab which fits into the open terminal portion of the channel and slot in the post. The caps thus render substantially invisible the open terminal portions of channel and slot.

8 Claims, 9 Drawing Figures

POST CAP APPARATUS

FIELD OF THE INVENTION

This invention relates in general to post signs, and in particular relates to improvements in signs having a message panel supported by one or more posts.

BACKGROUND OF THE INVENTION

Post signs generally comprise a message panel supported cantilever-fashion at one end by a single post, or supported at both ends by separate posts. Post signs are used in a variety of exterior sign applications, for example, to identify the name and address of a particular building or establishment, or to inform visitors of vehicular or pedestrian access routes.

Post signs, as with other building amenities, can be custom designed and individually fabricated for a particular application. This custom design and construction requires design, engineering, and fabrication services to produce signs which harmonize with the architectural setting of the building or other location, and which meet the appearance and quality standards of the surrounding environment. The cost of such custom signage may be difficult to justify in many applications. For this reason, manufactured sign systems are becoming increasingly popular.

Manufactured sign systems typically provide various interchangeable sign components, such as posts and message panels, which are interchangeably connectable to provide a post sign meeting the physical and architectural requirements of many diverse applications. The posts, panels, and other sign components are separately manufactured and cataloged; the architect or builder then specifies the components necessary to yield the desired signs, which are assembled on-site from these components. This arrangement provides the manufacturing economies and quality control benefits of manufactured products, and the interchangeability of related components in a sign system allows the architect some latitude in selecting the overall configuration and appearance of a particular assembled sign.

Because the posts, panels, and other components of manufactured signs are assembled at a job site to form the complete post sign, these components should mutually interconnect and assemble with the use of conventional tools. Moreover, signs assembled from manufactured components should be aesthetically pleasing, having no exposed slots, openings or the like frequently used for interconnecting message panels with one or more support posts. Furthermore, any interconnecting hardware used in the assembly, such as bolts, screws, clips, tabs, keys or the like, should be concealed from view or relatively unobstrusive at the most, in the finished product, so as not to detract from the overall aesthetic appearance of the sign.

SUMMARY OF INVENTION

Stated in general terms, signs constructed according to the present invention include at least one panel support post having a free end, and an elongated channel on a side of the post. At least one end of the channel is open adjacent the free end of the post, which also may be open, and an open slot extends between the elongated channel and an outer side of the post, permitting a sign support member to fit in the channel and extend through the opening to connect to a message panel. This sign support member preferably is an extruded part slidably fitting within the post channel and including a spacer extending through the open slot and outwardly a short distance from the post, for connection to the message panel. A spacer cap fits on the open end of the sign support member, covering this open end from the elements and from view. A separate cap fits on the open end of the post itself, without requiring screws or other fasteners or mating openings drilled or otherwise formed in the post. A flange extends downwardly from the post cap, filling the terminal portion of the post channel and engaging the spacer cap to prevent removal of the spacer cap.

Stated somewhat more particularly, the post cap includes a flange which extends downwardly from the cap and into the open end of the channel, occupying a terminal portion of that channel. This flange of the post cap includes a portion protruding outwardly through the open slot of the channel to substantially occupy a terminal portion of the open slot, this outer face being substantially flush with the side of the post interrupted by the slot. The outer face of the post cap flange thus forms a continuation of the interrupted post side, and renders the open terminal portion of the slot substantially invisible. Moreover, the flange holds the spacer cap firmly in place on the spacer extrusion, so that both the spacer cap and the spacer itself are secured in place on the post. The spacer cap may be held in place on the post by a securement device such as a small set screw or the like, extending through the flange and engaging the back wall of the post channel. This set screw is the only hardware required to lock or unlock the post cap system.

Accordingly, it is an object of the present invention to provide an improved post sign apparatus.

It is another object of the present invention to provide post sign apparatus that is relatively inexpensive to manufacture and easy to assemble into a post sign providing an aesthetically pleasing appearance.

It is a further object of the present invention to provide a post sign substantially fabricated from relatively inexpensive extruded components.

Other objects and advantages of the present invention will become more readily apparent from the following description of a preferred embodiment.

DETAILED DESCRIPTION OF PREFERRED EMBODIMENT

Figure 1:
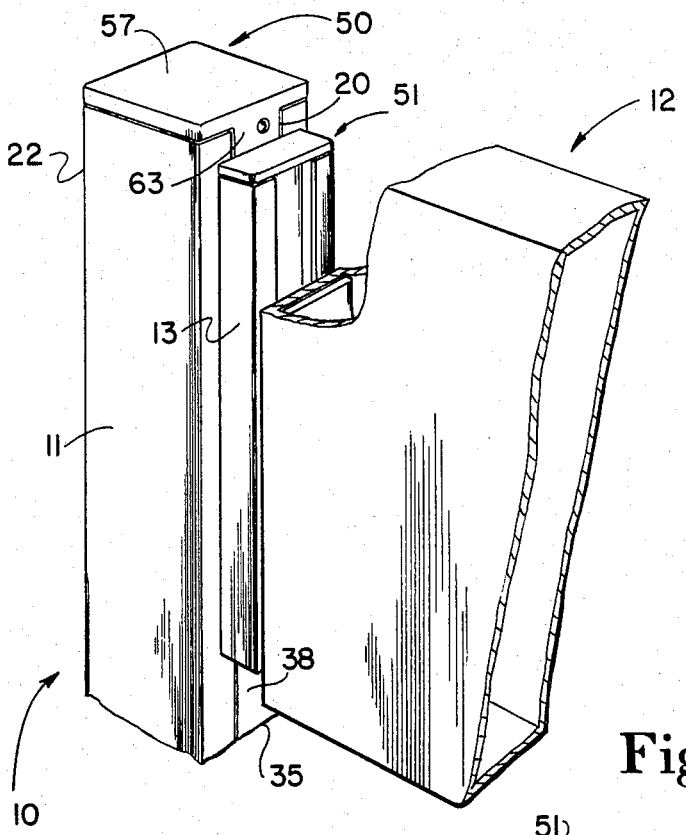
FIG. 1 is a fragmentary pictorial assembly view, partially broken away for illustrative purposes, showing a preferred embodiment of the present invention.
Figure 2:
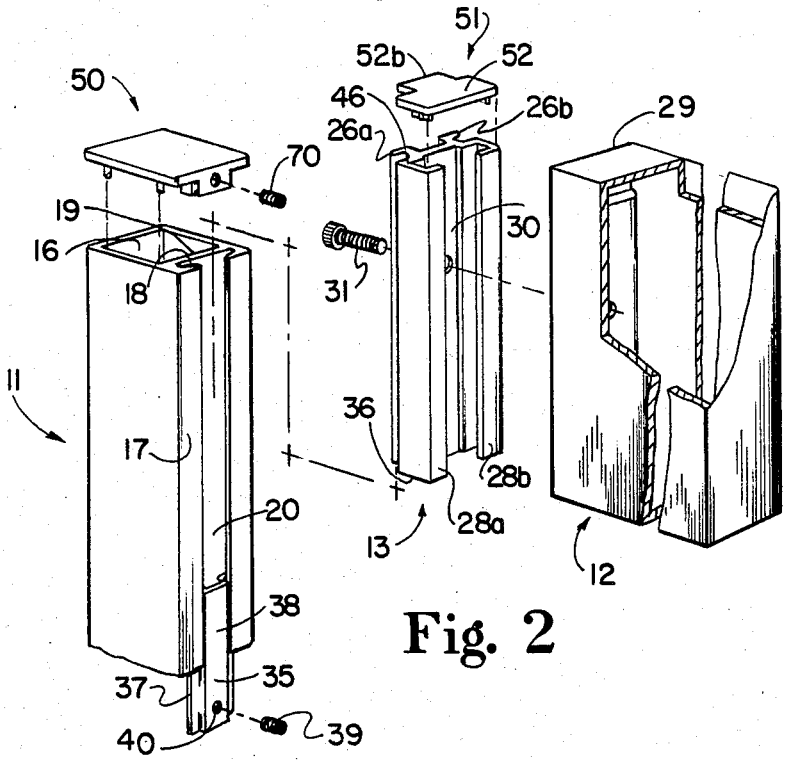
FIG. 2 is an exploded pictorial view of the embodiment shown in FIG. 1.
Figure 9:
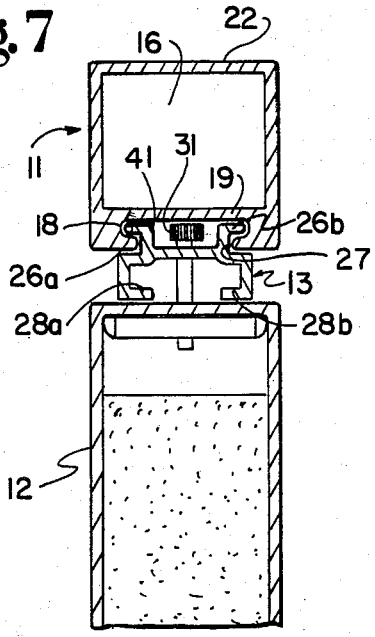
FIG. 9 is a horizontal section view of the assembled embodiment.

Turning first to FIGS. 1 and 2, there is shown generally at 10 a post sign embodying the present invention. The sign 10 includes a post 11 supporting one end of a sign message panel 12, both of which are shown only fragmentarily in the drawing figures. It will be understood by those skilled in the art that the panel 12 can be supported at only one end as shown in FIG. 1, or alternatively can be supported at both ends by another post and related structure not depicted herein. The panel 12 is connected to the post 11 by a support member 13 which spaces apart the post and panel, as best shown in FIG. 9.

Turning now to FIG. 2, the post 11 typically is hollow through its interior and has an open upper end 16. Formed along a side 17 of the post is the elongate channel 18, which is separated from the post interior by the inner wall 19 of the post. An elongated open slot 20 interrupts the side 17 of the post, permitting access to the channel 18 along the length of the post. The slot 20 is narrower than the maximum cross-section dimension of the channel 18, as best seen in FIG. 9, so that the channel and slot combine to form a somewhat-flattened T in cross-section across the width of the post 11. This post may be made of a suitable aluminum alloy and preferably is formed by extrusion, inasmuch as the post stock can be of indeterminate length from which individual posts are cut to the desired length. Although the post 11 in the preferred embodiment is square in cross-section, the back portion 22 of the post can be formed with other shapes such as a radius post, a bevel post, or the like.

The support member 13 also preferably is extruded from a suitable aluminum alloy, although other materials and fabricating techniques may be used. The support member 13, on the side facing the channel 18 of the post 11, has a pair of elongate flanges **26*a*, 26*b* together defining an overall cross-section shape complementary to the section of the channel 18. A central portion 27 (FIG. 9) of the support member 13 is narrowed to provide a sliding fit of the support member within the slot 20 of the post channel 18. On the side of the support member 13 opposite the channel-engaging flanges 26*a* and 26*b*, a pair of inwardly-facing and spaced apart elongated flanges 28*a* and 28*b* confront the adjoining side 29 of the sign panel 12. The sign confronting flanges 28*a*, 28*b* are spaced apart from each other and from the throat region 27 of the support member, defining an open elongate region 30 within the support member. This open region 30 permits unrestricted access of one or more fasteners 31 which extend through the throat 27 to engage the sides 29 of the panel 12, securing the support member 13 to the panel. As best seen in FIG. 9, the head of each fastener 31 is recessed within the elongated groove formed between the post channel-enaging flanges 26*a*, 26*b*, so as not to interfere with inserting or removing the support member on the post 11. The open configuration of the support member 13** also lends itself to forming this member by suitable extrusion techniques or the like.

Because the support member 13 is freely slidable along the channel 18 of the post 11 where the post is an extrusion formed without any internal stop structure, a filler member 35 (FIG. 2) is inserted in the channel immediately below the lower end 36 of the support member. This filler member 35 preferably has flanges 37 slidably fitting in the channel 18, and has a central portion 38 extending upwardly to substantially occupy the slot 20 on the post 11. As best seen in FIGS. 1 and 2, the central region 38 of the filler member 35 is designed to be substantially flush with the side 17 of the post 11. Thus, with the filler member 35 installed below the panel support member 13, no portion of the post channel 18 or slot 20 is visible below the support member 13.

The filler member 35 is held in place within the channel 18 by a set screw 39, FIG. 2, extending through and engaging a threaded opening 40 in the central region 38 of the filler member. This set screw, when turned inwardly, engages the face 41 of the inner wall 19 at the back of the channel 18, securing the filler member 35 in place and thus providing a fixed abutment on which rests the lower end 36 of the support member 13, within the channel.

Figure 8:
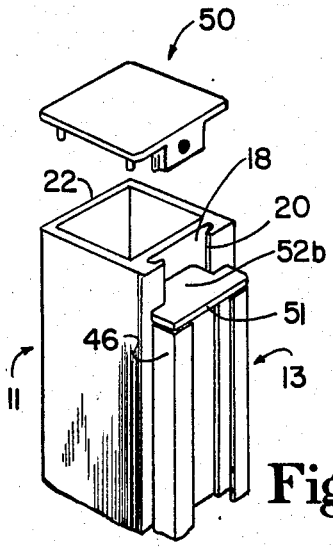
FIG. 8 is a pictorial view showing the disclosed embodiment partially assembled.

The post sign as described thus far is assembled in the following manner. The post 11 (or two such posts, if desired, are fixed in a suitable ground support and the filler member 35 is positioned to maintain the support member 13 at the appropriate location on the post. In the typical application, the upper end 46 of the support member will be slightly below the top of the post, leaving a terminal portion of the channel 18 unoccupied as seen in FIG. 8. Thus, both the open upper end 46 of the support member 13, and the open upper end 16 of the post 11 itself, must be closed to protect the sign from exposure to the elements, and to avoid an unsightly appearance. Moreover, the open terminal portion of the channel 18 should be closed for the same reasons. This closure is accomplished by the post cap 50 which fits on the open upper end of the post 11, and by the spacer cap 51 which fits on the open upper end of the support member 13.

Figure 6:
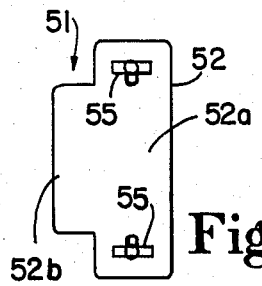
FIG. 6 is a bottom plan view of the spacer cap used in the disclosed embodiment.
Figure 7:
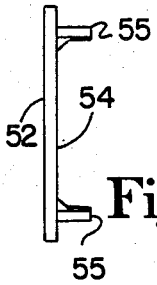
FIG. 7 is an elevation view of the spacer cap shown in FIG. 6.

Considering first the spacer cap 51, best shown in FIGS. 2, 6, and 7, the spacer cap has a substantially flat body 52 with a main body portion **52*a* configured to substantially completely overlie the upper end 46 of the support member 13, specifically the two flanges 28*a* and 28*b* and the open space 30 between those channels. The spacer cap body also includes a finger 52*b* projecting outwardly from one side of the main body 52, and configured to fit through the slot 20 entering the channel 18 on the post 11. This arrangement is best shown in FIG. 8. The width of the finger portion 52*b* is only slightly less than the width of the slot 20, allowing the spacer cap 51 to be freely yet snugly received on the support member 13 with the finger extending through the slot 20**, as shown.

Extending outwardly from the underside 54 of the spacer cap 51 are a pair of securing projections 55, FIG. 7. These projections are located to engage the sides of the open space 30 in the support member 30 and thus provide a frictional fit in the open upper end 46 of the support member, so that the spacer cap is held in place as shown in FIG. 8.

Figure 3:
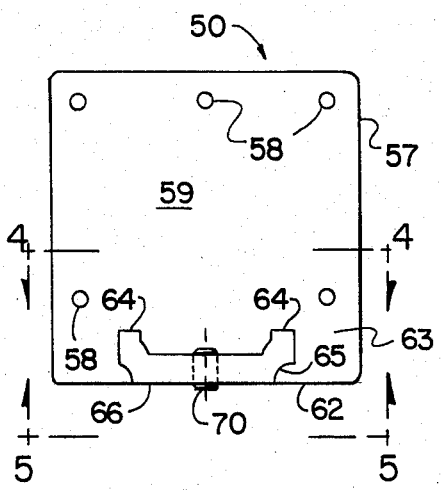
FIG. 3 is a bottom plan view of the post cap in the disclosed embodiment.
Figure 4:
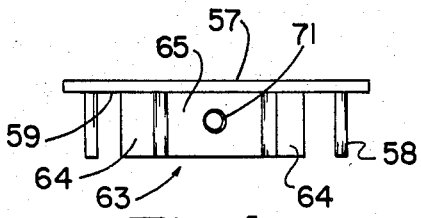
FIG. 4 is a section view taken along line 4—4 of FIG. 3.
Figure 5:
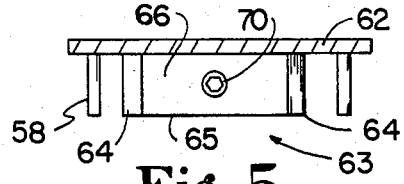
FIG. 5 is an elevation view taken along line 5—5 of FIG. 3, facing the flange side of the post cap.

The post cap 50, best seen in FIGS. 3–5, has a flat main body 57 having an overall plan shape conforming to the overall cross-section exterior shape of the post 11. A number of posts 58 extend outwardly from the underside 59 of the body 57. The posts 58 are located for frictional sliding engagement with the inside surfaces at the open upper end 16 of the post 11, as indicated in FIG. 2, when the post cap is placed on that upper end. The posts 58 are integrally molded as part of the post cap 50, which preferably is molded of a suitable plastic material or the like.

Extending outwardly from a side 62 of the post cap body 57, and perpendicular to the body 57, is the tab 63. This tab, which also preferably is an integral part of the molded post cap 50, is configured to provide a sliding fit into the terminal open end of the channel 18 formed in the post 11. For this purpose, the tab 63 includes a pair of outwardly-facing flanges 64 configured to provide a sliding fit within the broadest part of the channel 18; these flanges thus are functionally equivalent to the flanges 26*a*, 26*b* on the support member 13. The flanges 64 are formed at both sides of a central body 65 wide enough to slidingly fit in the slot 20 of the post side 17, with minimum clearance between the central body and the sides of the slot. The outer face 66 of the tab body 65 is flush with the post side 17 when the post cap is in place on the post, as best seen in FIG. 1. The tab 63 of the post cap thus occupies and completely covers the terminal open end of the slot 20 and the channel 18, rendering the channel and slot substantially invisible to an observer of the assembled post sign 10. Moreover, the bottom edge 67 of the tab 63 contacts the spacer cap 51 and secures the spacer cap in place on the support member 13.

The post cap 50 is secured in place on the post 11 by a set screw 70 threaded through a hole 71 in the body 65 of the post cap tab 63. This set screw is threaded inwardly after the post cap is in place on the open upper end 16 of the post 11, forcing the inner end of the set screw against the face 41 at the back of the channel 18 and thereby securing the post cap on the post.

It should now be understood that the assembled post sign 10 provides a professional and finished appearance, leaving no unexposed channels or slots to detract from the appearance of the sign. The only hardware feature exposed to view with the present sign is the set screw 70, which is relatively unobtrusive and is partially concealed by the confronting upper corner of the panel 12. Moreover, the post 11, support member 13, and filler member 35 each are open extrusions to minimize fabricating costs; these elements require no drilling or other special preparation, and can simply be cut to length from lengths of extruded stock. The post cap and spacer cap also are relatively inexpensive to fabricate. The entire sign is easily and quickly assembled at the point of installation, and the sign is as easily disassembled to remove or replace the message panel.

It will also be understood that the foregoing relates only to a preferred embodiment of the present invention, and that numerous changes and modifications may be made therein without departing from the spirit and scope of the invention as set forth in the following claims.

We claim:

1. Sign apparatus comprising:

a sign post having an open end;

a longitudinal channel on a side of said post, the channel having an open end located adjacent said open end of the post;

an elongated open slot extending along said side of the post and communicating with said channel;

a sign support member partially occupying said channel and having an end spaced apart from said open end of the channel, so that a terminal portion of the channel remains visible and unoccupied by the sign support member, and so that said end of the sign support member is longitudinally displaced from said open end of the sign post;

mounting means associated with said sign support member and extending through said open slot to engage a message display means;

a post cap removably mounted on said open end of the post; and said cap having a tab longitudinally extending into and occupying said terminal portion of said channel above the sign support member received in the channel, so that the terminal portion is occupied and thus unexposed to view from outside the post.

2. Apparatus as in claim 1, wherein:

said cap comprises first means received within the open end of the post to engage the post and retain the cap on the post.

3. Apparatus as in claim 1 wherein:

the open end of said channel is contiguous to the open end of the post;

said tab of the cap extends into the open end of the channel to terminate at the sign support member; and said tab has an external shape complementary to the cross-section shape of the channel and substantially completely occupies the channel terminal portion from the sign support member to the open end of the channel.

4. Sign apparatus as in claim 1, wherein:

said sign support member comprises an extrusion and said mounting means thus has an open end outside said side of the post, below said terminal portion of said channel; and further comprising a support member cap removably attached to close the open end of said mounting means outside the post; and said tab of the post cap extends longitudinally in said channel and engages said support member cap, thereby retaining the support member cap in place on the open end of the mounting means outside the slot of said side of the post.

5. Sign support apparatus as in claim 4, wherein:

said support member cap comprises a cover portion extending over and closing the open end of the mounting means extrusion, and also comprises a tongue extending through said open slot in the side of the post; and said tongue underlies and is engaged by said tab of the post cap, so that the tab of the post cap presses the tongue of the support member cap against said end of the support member cap, whereby the post cap retains the support member cap in place on said mounting means.

6. In a sign including a hollow post having an open free end, an elongated channel on a side of the post and having an open end adjacent the open end of the post, and an elongated open slot extending between the elongated channel and the exterior of the post, the improvement comprising:

a sign support member received in said channel at a predetermined location spaced longitudinally inwardly from the open end of the channel so as to leave a terminal longitudinal portion of the channel unoccupied, said support member having means extending through said slot for operative association with a message display;

said sign support member having an open end facing the same direction as said open ends of the post and the channel, but displaced longitudinally inwardly therefrom;

a support member cap fitting into and closing said open end of the sign support member, so as to render the open end of the sign support member substantially invisible;

a post cap fitting on and closing said open end of the post, said post cap having an edge located adjacent said open end of the elongated channel;

said post cap having a flange extending longitudinally from said edge into the open end of the channel to contact and retain said support member cap in said open end; and means operatively associated with said post cap for selective engagement with said post so as to secure the post cap to the post, whereby the secured post cap retains said support member cap in place and thereby prevents removal of said sign support member from the post.

7. Apparatus as in claim 6, wherein said support member cap includes a tongue extending through the open slot in the post and entering the elongate channel;

said flange on the post cap extends inwardly along the terminal portion of the channel to press against said tongue of the support member cap, thereby retaining the support member cap in place on the open end of the sign support member; and said flange includes a portion protruding outwardly through said open slot and substantially filling the terminal portion of the open slot, the outer face of said portion being substantially flush with the post side interrupted by the slot, so that said outer face forms a continuation of the interrupted post side and thereby renders the open slot substantially invisible.

8. Apparatus as in claim 7, further comprising:

post engaging means associated with said flange and selectably operative to engage the post and thereby releasably retain the post cap in place on the post.

* * * * *